US006994552B2

(12) United States Patent
Hirata et al.

(10) Patent No.: US 6,994,552 B2
(45) Date of Patent: Feb. 7, 2006

(54) HAIR DESIGN SYSTEM AND ITS APPLICATIONS

(75) Inventors: Yoshihiro Hirata, Kyoto (JP); Yuko Yamashita, Kyoto (JP)

(73) Assignee: Phild Co., Ltd., Kyoto (JP)

( * ) Notice: Subject to any disclaimer, the term of this patent is extended or adjusted under 35 U.S.C. 154(b) by 311 days.

(21) Appl. No.: 10/312,190

(22) PCT Filed: Jul. 2, 2001

(86) PCT No.: PCT/JP01/05702

§ 371 (c)(1),
(2), (4) Date: Feb. 26, 2003

(87) PCT Pub. No.: WO02/01984

PCT Pub. Date: Jan. 10, 2002

(65) Prior Publication Data

US 2003/0160827 A1 Aug. 28, 2003

(51) Int. Cl.
*G09B 19/10* (2006.01)

(52) U.S. Cl. ..... 434/94; 434/99; 434/377; 345/419; 345/634

(58) Field of Classification Search ..... 434/94, 434/99, 100, 365, 371, 377; 345/173, 419, 345/420, 473, 629, 630, 634; 132/200, 213, 132/214; 702/19, 90; 33/512; 424/70.1; 463/25; 446/268; 707/104.1
See application file for complete search history.

(56) References Cited

U.S. PATENT DOCUMENTS 2,518,262 A 8/1950 Wilson
2,529,149 A 11/1950 Fred
2,558,516 A 6/1951 Granberg
2,581,704 A 1/1952 Reno
2,808,840 A 10/1957 De Santis
2,919,702 A * 1/1960 Olivo ..... 132/200
2,975,534 A 3/1961 Lutz
3,101,557 A 8/1963 Watlington et al.
3,458,943 A 8/1969 Trowbridge
4,258,478 A * 3/1981 Scott et al. ..... 434/94
4,317,462 A * 3/1982 Steiner ..... 132/213
4,370,137 A 1/1983 Herzig et al.
4,403,962 A * 9/1983 La Vista ..... 434/94
4,434,467 A * 2/1984 Scott ..... 700/90
4,619,280 A * 10/1986 Yampolskaya ..... 132/214
4,669,985 A 6/1987 Hvalsbraten (Continued)

FOREIGN PATENT DOCUMENTS

DE 198 16 631 A1 10/1999

(Continued)

*Primary Examiner*—Joe H. Cheng
(74) *Attorney, Agent, or Firm*—Knobbe, Martens, Olson & Bear LLP

(57) ABSTRACT

As shown in FIG. 1, a hairstyle design system comprises an image-processing device 1, an input/output device 2, a graphic system 3, a display device 4, a head-development drawing information-storage device 5, and a hairstyle-design information-storage device 6. In other words, the beautician or the customer designs a desired hairstyle while looking at the display device 4. Information on the designed hairstyle is stored in the head-development drawing information-storage device 5 as numerals and/or symbols assigned to each of a plurality of divided sections. When processing hair, the beautician displays a head-development drawing on the display device 4, and by referring to the drawing the beautician cuts or applies permanent wave to the hair in order to design a hairstyle precisely as desired by the customer and reproduce a predetermined hairstyle accurately.

13 Claims, 8 Drawing Sheets

U.S. PATENT DOCUMENTS

| | | | | | |
|---|---|---|---|---|---|
| 4,776,796 | A | * | 10/1988 | Nossal | 434/94 |
| 4,807,163 | A | * | 2/1989 | Gibbons | 702/19 |
| 4,810,196 | A | * | 3/1989 | Walker | 434/94 |
| 4,823,285 | A | * | 4/1989 | Blancato | 345/630 |
| 5,174,037 | A | * | 12/1992 | Curtin | 33/512 |
| 5,252,074 | A | * | 10/1993 | Passage et al. | 434/94 |
| 5,267,154 | A | * | 11/1993 | Takeuchi et al. | 345/473 |
| 5,358,407 | A | * | 10/1994 | Lainer | 434/94 |
| 5,404,426 | A | * | 4/1995 | Usami et al. | 345/420 |
| 5,588,096 | A | * | 12/1996 | Sato et al. | 345/634 |
| 5,818,428 | A | * | 10/1998 | Eisenbrandt et al. | 345/173 |
| 5,832,937 | A | | 11/1998 | Fujikawa | |
| 5,966,137 | A | * | 10/1999 | Murata | 345/629 |
| 6,065,969 | A | * | 5/2000 | Rifkin et al. | 434/100 |
| 6,141,431 | A | * | 10/2000 | Munetsugu et al. | 382/100 |
| 6,142,876 | A | * | 11/2000 | Cumbers | 463/25 |
| 6,206,750 | B1 | * | 3/2001 | Barad et al. | 446/268 |
| 6,226,013 | B1 | * | 5/2001 | Murata et al. | 345/634 |
| 6,578,023 | B1 | * | 6/2003 | Kagami et al. | 706/54 |
| 6,633,289 | B1 | * | 10/2003 | Lotens et al. | 345/419 |
| 6,719,565 | B1 | * | 4/2004 | Saita et al. | 434/94 |
| 6,842,172 | B2 | * | 1/2005 | Kobayashi | 345/419 |
| 2002/0165868 | A1 | * | 11/2002 | Kayahara | 707/104.1 |
| 2004/0202631 | A1 | * | 10/2004 | Hirata et al. | 424/70.1 |

FOREIGN PATENT DOCUMENTS

| | | | | |
|---|---|---|---|---|
| JP | 39-27686 | | | 12/1964 |
| JP | 49-105661 | | | 10/1974 |
| JP | 53-36378 | | | 10/1978 |
| JP | 56-109616 | | | 8/1981 |
| JP | U 58-48180 | | | 3/1983 |
| JP | 58-97306 | | | 6/1983 |
| JP | U 59-98821 | | | 7/1984 |
| JP | U 59-98822 | | | 7/1984 |
| JP | 60-45303 | | | 3/1985 |
| JP | U 60-64722 | | | 5/1985 |
| JP | 02-234707 | | | 9/1990 |
| JP | U 05-91519 | | | 12/1993 |
| JP | 06-012474 | | | 1/1994 |
| JP | 07-067721 | | | 3/1995 |
| JP | 08-096111 | | | 4/1996 |
| JP | 08130732 | A | * | 5/1996 |
| JP | 09-098834 | | | 4/1997 |
| JP | 10-014655 | | | 1/1998 |
| JP | 2000-023740 | | | 1/2000 |
| JP | 2001-190328 | | | 7/2001 |
| WO | WO 98/21695 | | | 5/1998 |

* cited by examiner

FIG. 11

| SL | BL | | BR | SR |
|---|---|---|---|---|
| $SL_1$ | $BL_1$ | $F_1$ | $BR_1$ | $SR_1$ |
| $SL_2$ | $BL_2$ | $F_2$ | $BR_2$ | $SR_2$ |
| $SL_3$ | $BL_3$ | $F_3$ | $BR_3$ | $SR_3$ |
| $SL_4$ | $BL_4$ | $F_4$ | $BR_4$ | $SR_4$ |
| $SL_5$ | $BL_5$ | $T_1$ | $BR_5$ | $SR_5$ |
| $SL_6$ | $BL_6$ | $T_2$ | $BR_6$ | $SR_6$ |
| $SL_7$ | $BL_7$ | $T_3$ | $BR_7$ | $SR_7$ |
| $SL_8$ | $BL_8$ | $T_4$ | $BR_8$ | $SR_8$ |
| | $BL_9$ | $BC_1$ | $BR_9$ | |
| | $BL_{10}$ | $BC_2$ | $BR_{10}$ | |
| | $BL_{11}$ | $BC_3$ | $BR_{11}$ | |
| | $BL_{12}$ | $BC_4$ | $BR_{12}$ | |
| | | $BC_5$ | | |
| | | $BC_6$ | | |
| | | $BC_7$ | | |
| | | $BC_8$ | | |
| | | $BC_9$ | | |
| | | $BC_{10}$ | | |
| | | $BC_{11}$ | | |
| | | $BC_{12}$ | | |
| | | $BC_{13}$ | | |
| | | $BC_{14}$ | | |
| | | $BC_{15}$ | | |
| | | $BC_{16}$ | | |
| | | BC | | |

HAIR DESIGN SYSTEM AND ITS APPLICATIONS

This application is the U.S. National Phase under 35 U.S.C. §371 of International Application PCT/JP01/05702, filed Jul. 2, 2001, which claims priority to Japanese Patent Application Nos. 2000-200542, filed Jul. 3, 2000, and 2000-375398, filed Dec. 11, 2000. The International Application was published under PCT Article 21(2) in a language other than English.

FIELD OF THE INVENTION

This invention relates to a hairstyle design system, specifically a hairstyle design system that utilizes a computer-based image-processing system for the design of hairstyles and the display of hairstyle images for assistance in the beautician's creative process. The invention also relates to the use of the hairstyle design system.

BACKGROUND OF THE INVENTION

It is said that hairstyling using permanent wave and other techniques is as important to the modem woman as her livelihood. The woman considers a hairstyle, achieved through various types of processing such as cutting, permanent waving and coloring, as an important element in the creation of a favorable impression. In other words, a desired hairstyle is achieved through a combination of permanent waving, cutting and blow-drying. However, since it is difficult for most women to design the desired hairstyles on their own, they are actually unable to direct their beauticians to ensure that their hair is styled according to what is desired.

Conventionally, the female customer at a beauty salon determines her favorite types of cutting, coloring and permanent waving by referring to hairstyle models (images of hairstyle samples), hairstyle designs featured in magazines, the beautician's advice and so forth. The customer then verbally places her order with the beautician, who in turn processes the customer's hair according to the requested hairstyle. Alternatively, the beautician may process the customer's hair according to what the beautician recalls the customer's customary, desired hairstyle to have been. Another alternative is to leave the entire process up to the beautician. Evidently, due to the absence of accurate documentation on the customer's favorite mode of hair processing, much of it depends on the beautician's sensitivity and skill. Cutting, coloring, permanent waving and the like are normally employed at the discretion of the beautician.

Adult hair strands range in diameter from 0.09 to 0.5 mm, on the average. Anywhere from 100,000 to 150,000 strands of hair, grown to approximately 50 percent, cover the head despite the natural process of hair loss (50 to 100 strands per day). A hair grows about 1.1 to 1.3 cm over a period of a month, necessitating cutting and permanent waving once every four to five weeks, although requirements vary among individuals. The female customer orders her desired hairstyle each time she visits a beauty salon for a haircut and permanent wave. It isn't at all rare that the customer will feel dissatisfied with some imperfect conformance of the finished hairstyle to the one she desired, although the beautician's skills are a factor in that. For this reason the customer tends to return to the same salon, and the salon assigns the same beautician to that customer each time she returns. Still, it is difficult to process customers' hairstyles exactly as they want, given the infinite variations in hairstyle requests. Even if the beautician achieves the customer's favorite hairstyle once, it is virtually impossible to get the same result at the next permanent-wave session.

Hairstyling includes hair setting with curlers and blow-styling using instruments such as a dryer and brush. The process of hair setting normally involves rolling strands of hair around curlers and then drying, followed by setting the entire hairstyle. Blow-styling normally entails dividing the head of hair into several parts and drying individual parts separately, in sequence, with a dryer in order to achieve a final, overall style. In the conventional hairstyling, the customer gradually arrives at a final hairstyle that would best suit her by referring to a photograph of a desired hairstyle sample pasted to the mirror while consulting with the beautician. Examples of this method are disclosed in Japanese Utility Model Application Laid-open Nos. 58-48180, 59-98821, 59-98822, 60-64722 and 5-91519. However, it is still difficult to style each customer's hair exactly as desired by the customer and to reproduce the ideal hairstyle, given the unique characteristics of each customer's head and face. Three-dimensional head models with simulated strands of synthetic fiber or animal or human hair planted thereon have been used but never for the purpose of reproducing a given hairstyle.

Methods for the design of a customer's desired hairstyle are known, wherein the desired hairstyle is designed through constant reference to a hairstyle model and a predicted hairstyle pattern for the customer displayed on a TV monitor or computer. Examples of such methods are disclosed in Japanese Patent Application Laid-open Nos. 58-97306, 56-109616, 60-45303, 7-67721, 9-98834 and 10-14655. Nevertheless, it remains difficult to achieve a hairstyle precisely as desired by any one customer simply by applying the displayed three-dimensional visual information to the hairstyling process, given that the head and facial shapes vary from one customer to the next.

To solve the foregoing problems, the inventors of the present invention proposed a hairstyling method based on the use of numerals and/or symbols in Japanese Patent Application No. 2000-001315. That invention aims to design a hairstyle precisely as desired by the customer, and to fully implement and reproduce the hairstyling process in accordance with the desired hairstyle. Accordingly, the desired hairstyle is translated into numerals and/or symbols. Those numerals and/or symbols are then entered on a prescribed "head-development drawing" to finalize the hairstyle. The hair is then styled with reference to the drawing.

SUMMARY OF THE INVENTION

The aforementioned existing method, however, had problems in that it required not only that the numerical and/or symbolic representation of a hairstyle be entered into a head-development drawing, but also the time needed to train the operator in the use of the system, thereby rendering the method inefficient.

The present invention herein described aims to offer a hairstyle design system through a simple configuration that will solve the aforementioned problems, and that will allow the design and standardization of hairstyles precisely as desired by beauty-salon customers, and that will facilitate the achievement of a hairstyle exactly as was previously designed.

To solve the aforementioned problems, the hairstyle design system of the present invention is configured to comprise: an input/output device with which to input instructions for selecting or processing images and for outputting status information; a graphic system that converts image information into image data for display; a display device for the display of head image data, as converted by the graphic system, and a head-development drawing; a head-development drawing information-storage device that stores hairstyle design data entered as numerals and/or symbols representing hair length and color and the type of permanent wave to be used for each part of the head; a hairstyle-design information-storage device that stores a plurality of hairstyle-model data sets which serve as samples for hairstyle design; and an image-processing device that outputs to the graphic system a synthesized or modified image based on the hairstyle design data, as retrieved from the head-development drawing information-storage device and the hairstyle-design information-storage device on instructions from the input/output device, and which writes the resultant processed hairstyle design data into the head-development drawing information-storage device and the hairstyle-design information-storage device.

The present invention also comprises the following methods:

(1) A hairstyle design method whereby the customer and/or a third party determines a hairstyle as designed through the aforementioned hairstyle design system;

(2) A hair-processing method whereby the beautician processes hair by reproducing on a display device the electronic information obtained through the aforementioned hairstyle design system; and (3) A hair-processing method whereby the beautician processes hair by referring to a head-development drawing on which numerals and/or symbols are entered for each of a plurality of divided sections, said numerals and/or symbols corresponding to a hairstyle design output based on the electronic information obtained through the aforementioned hairstyle design system.

The methods allows a hairstyle to be designed precisely as desired by the customer, and allow the customer's desired hair design to be reproduced exactly.

The present invention is also capable of ensuring repeated and consistent hair processing, thereby meeting the beauty and haircutting needs of large numbers of people. It is highly useful in the industry and is of significant service to society.

BRIEF DESCRIPTION OF THE DRAWINGS

FIG. 11: A development drawing of the subsections, as used in a hairstyle design system in an embodiment of the present invention.

DESCRIPTIONS OF THE SYMBOLS

Figure 1:
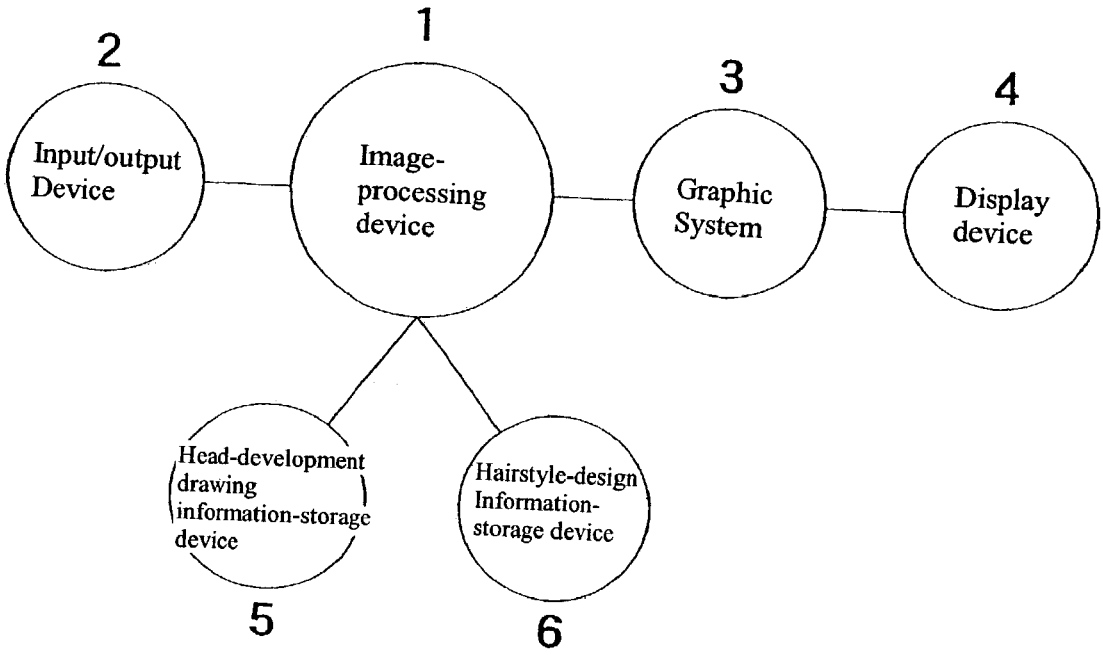
FIG. 1: A functional block diagram of a hairstyle design system in an embodiment of the present invention.

1: Image-processing device
2: Input/output device
3: Graphic system
4: Display device
5: Head-development drawing information-storage device
6: Hairstyle-design information-storage device
LTF: Left-side top front
LTS: Left-side top side
LUS: Left-side underside
LNA: Left-side nape
F: Front
T: Top
BC: Back center
SL: Side left
BL: Back left
SR: Side right
BR: Back right

BEST MODE FOR CARRYING OUT THE INVENTION

A detailed explanation on embodiments of the present invention follows with reference to FIGS. 1 through 11.

An embodiment of the present invention is a hairstyle design system utilizing a computer-based image-processing system that allows the design of a desired hairstyle while looking at a display device, and outputs a head-development drawing on which numerals and/or symbols entered for each of a plurality of divided sections for use by the beautician in processing the hair.

FIG. 1 is a functional block diagram of the hairstyle design system in the embodiment of the present invention. In FIG. 1, an image-processing device 1 is a CAD/CAM system or other computer-based image-processing system that synthesizes hairstyle design data, as expressed in numerals and/or symbols, into image information and/or modifies an image. An input/output device 2 provides a means of inputting command information via a keyboard, mouse, microphone or the like, and a means of outputting status information via a printer, speaker or the like. A graphic system 3 is a device that converts the image information, as synthesized by the image-processing device, into image data for display. A display device 4 is a CRT or LCD display device. A head-development drawing information-storage device 5 provides a means of storing data on hair length and color in the form of numerals and/or symbols for each part of the head. A hairstyle-design information-storage device 6 provides a means of storing a plurality of hairstyle model information and other information relating to hairstyle designs. The head-development drawing information-storage device 5 and the hairstyle-design information-storage device 6 are typically hard-drive devices, but may also be magneto-optical discs, CD-R, DVD-RAM or other nonvolatile storage devices that allow the writing and reading of information.

Figure 2:
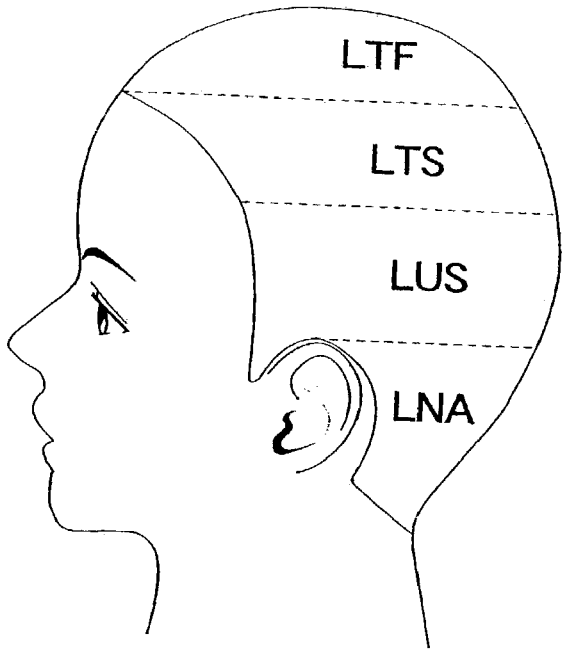
FIG. 2: A drawing showing the major sections on one side of the head, as used in a hairstyle design system in an embodiment of the present invention.
Figure 3:
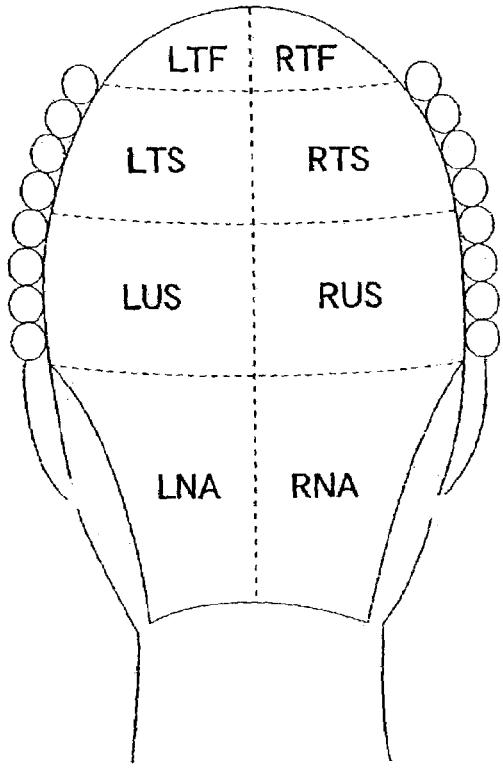
FIG. 3: A drawing showing the major sections at the back of the head, as used in a hairstyle design system in an embodiment of the present invention.
Figure 4:
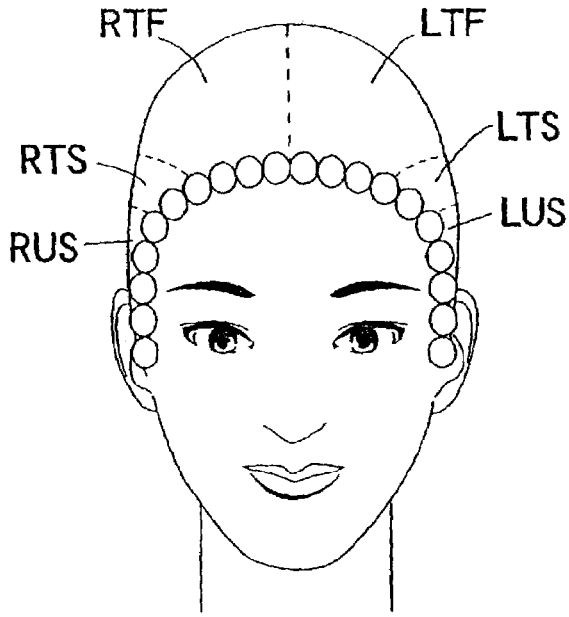
FIG. 4: A drawing showing the major sections at the front of the head, as used in a hairstyle design system in an embodiment of the present invention.
Figure 5:
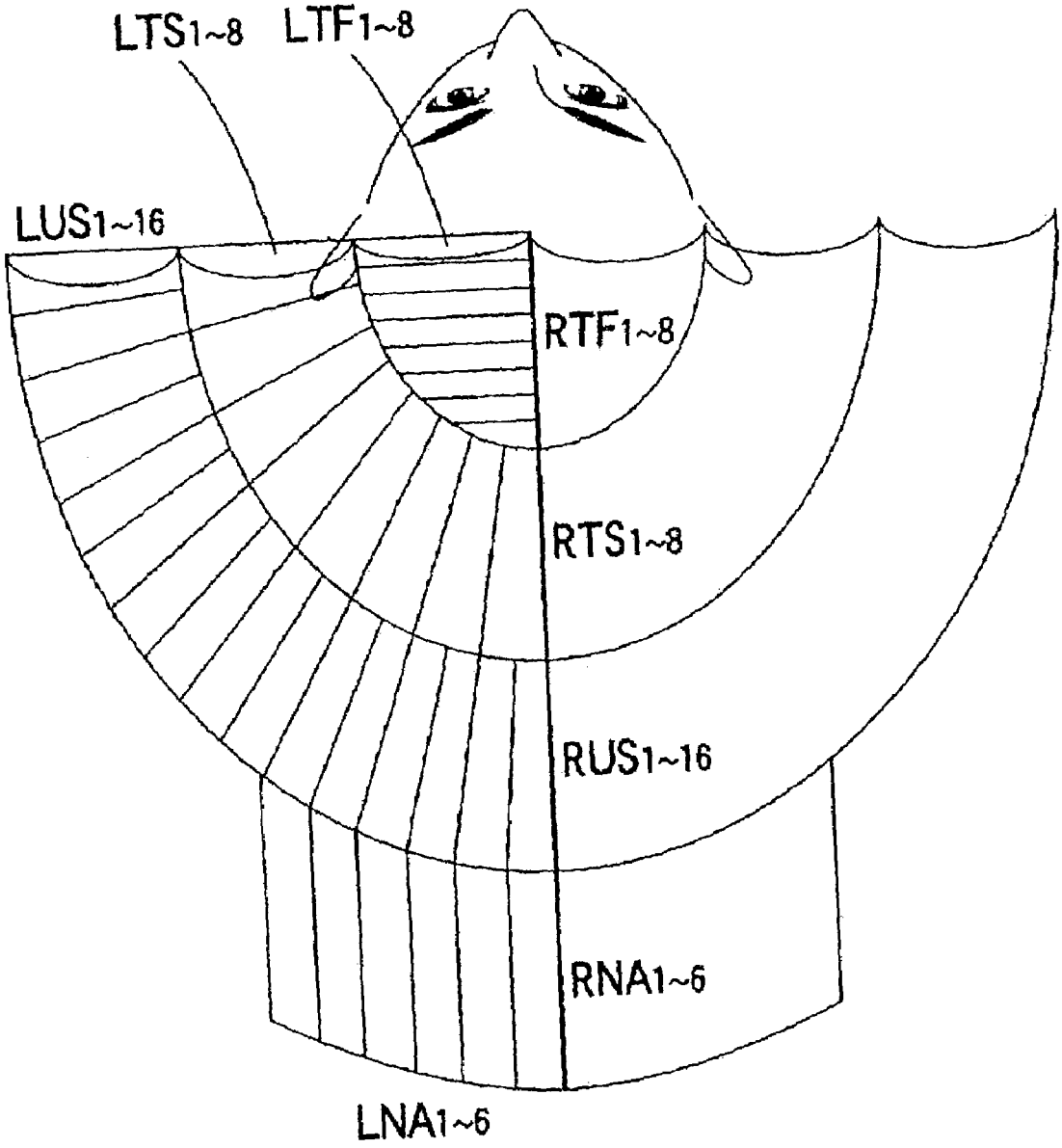
FIG. 5: A development drawing of the subsections, as used in a hairstyle design system in an embodiment of the present invention.
Figure 6:
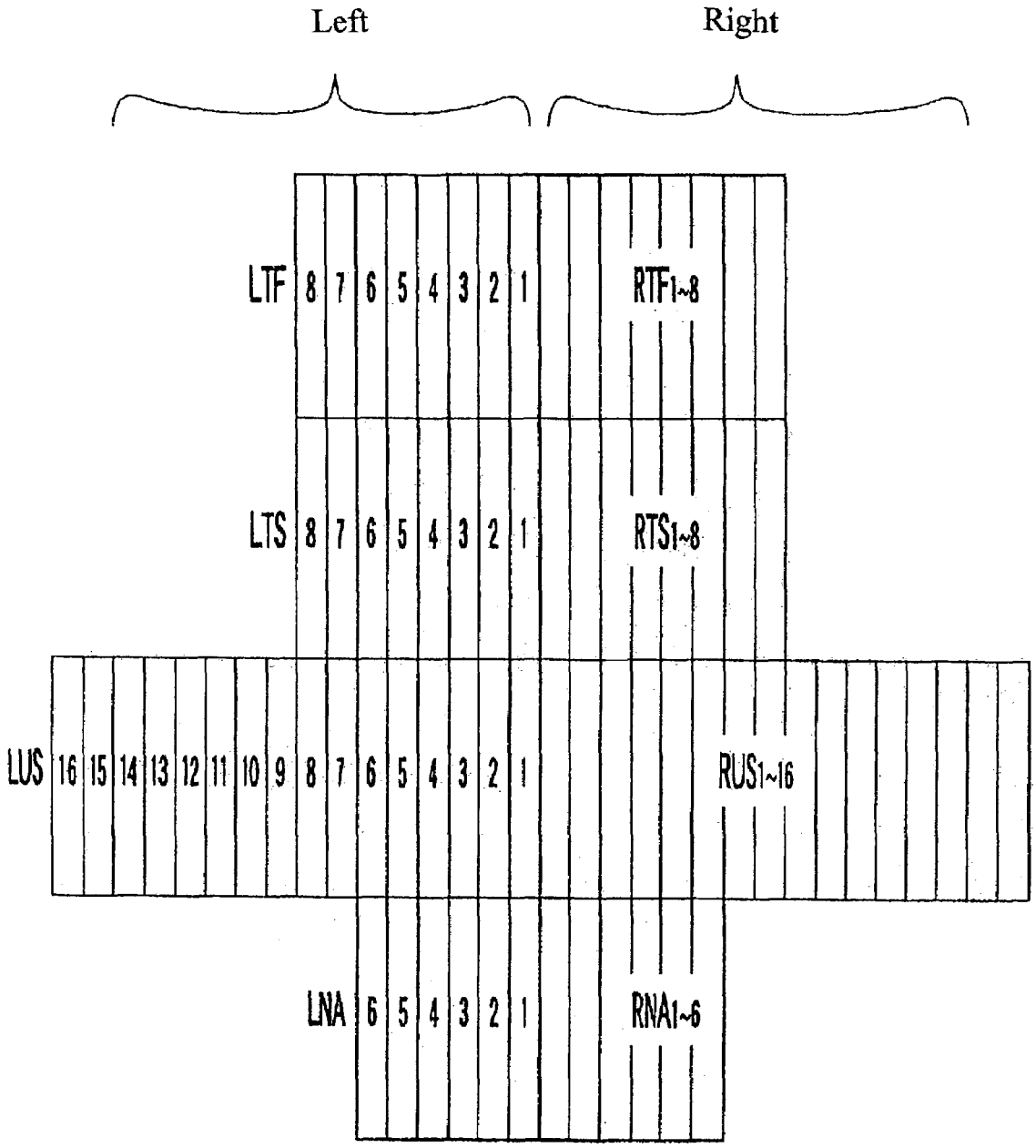
FIG. 6: A development drawing of the subsections, as used in a hairstyle design system in an embodiment of the present invention.
Figure 7:
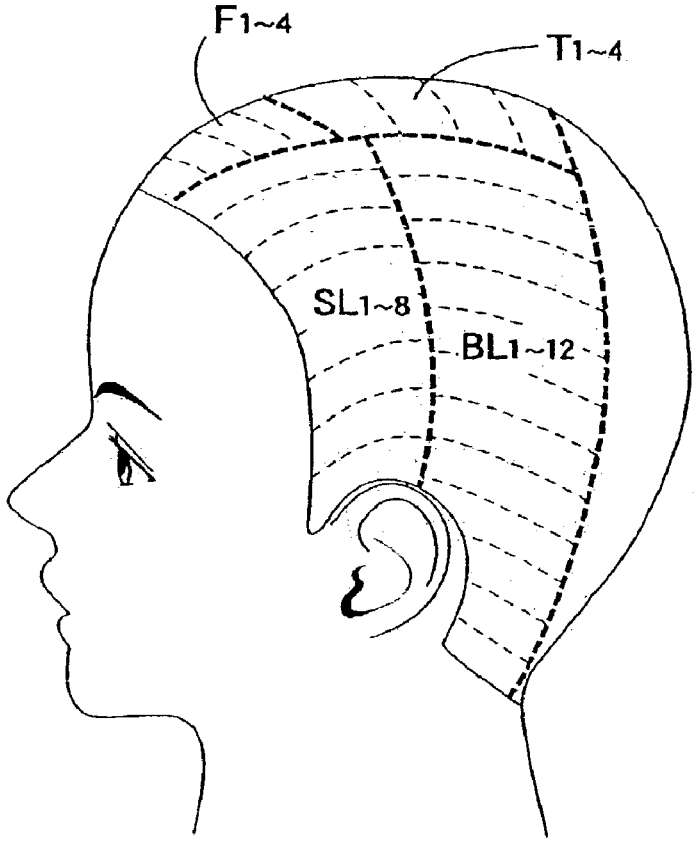
FIG. 7: A drawing showing the major sections on one side of the head, as used in a hairstyle design system in an embodiment of the present invention.
Figure 8:
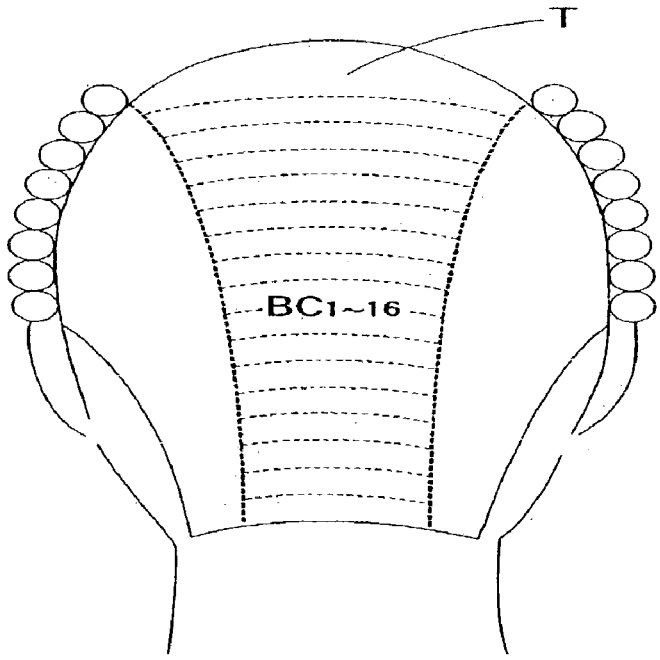
FIG. 8: A drawing showing the major sections at the back of the head, as used in a hairstyle design system in an embodiment of the present invention.
Figure 9:
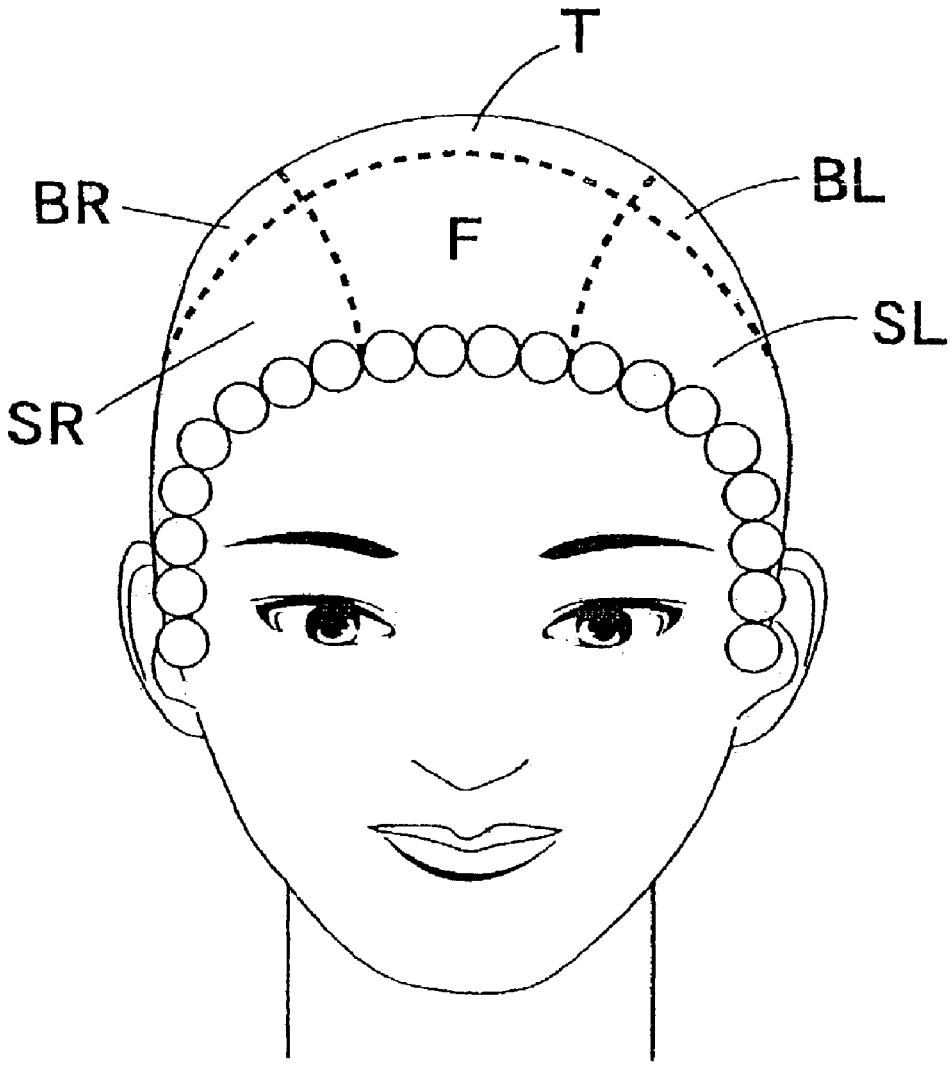
FIG. 9: A drawing showing the major sections at the front of the head, as used in a hairstyle design system in an embodiment of the present invention.
Figure 10:
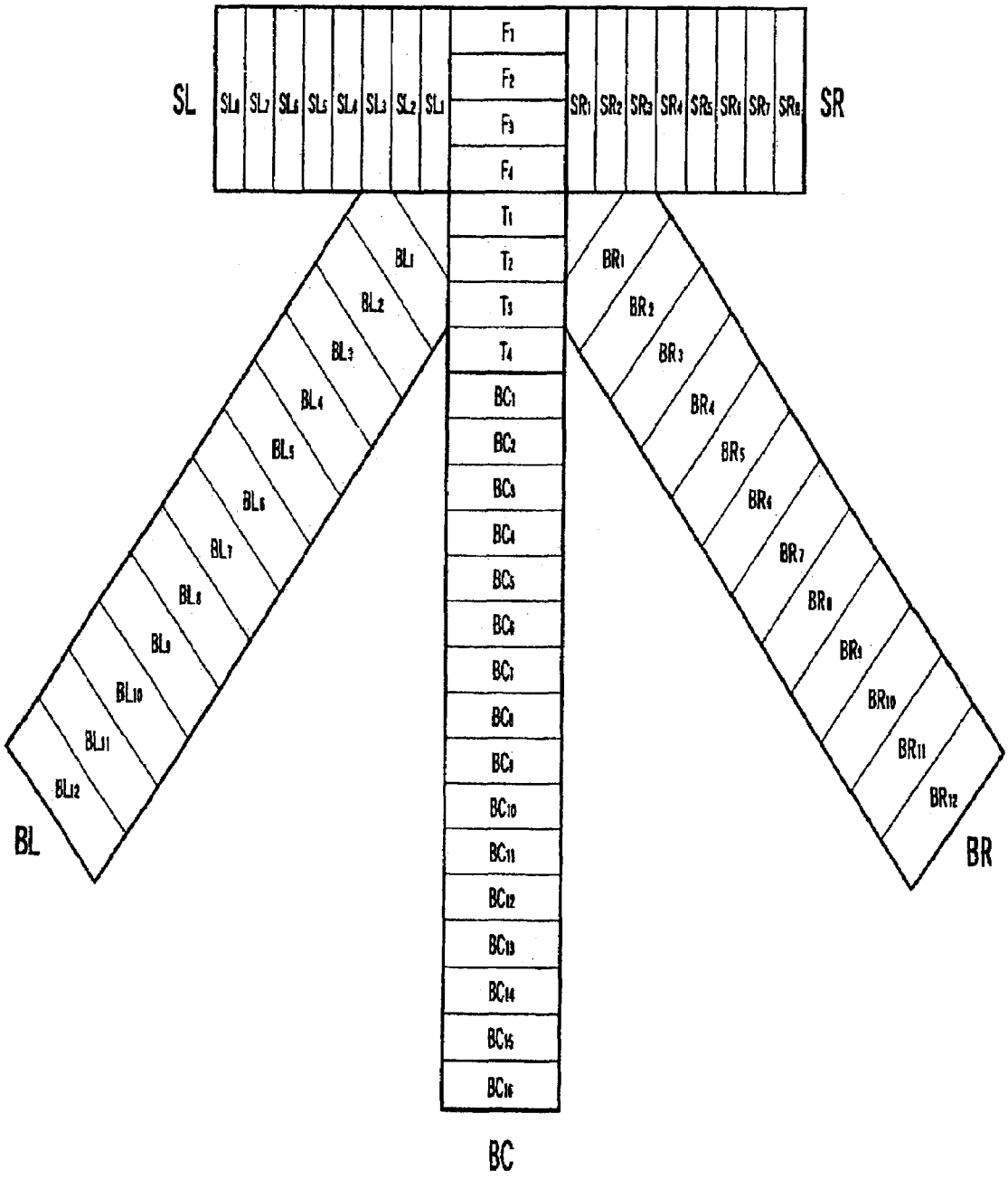
FIG. 10: A development drawing of the subsections, as used in a hairstyle design system in an embodiment of the present invention.

FIG. 2 is a drawing showing the left side (left and right as perceived by the subject) of a head model, which serves as the basis for the head-development drawing to be output by the hairstyle design system of the present invention. FIG. 3 is a drawing showing the back of a head model, which serves as the basis for the head-development drawing. FIG. 4 is a drawing showing the front of a head model, which serves as the basis for the head-development drawing. FIG. 5 is a development drawing showing a head developed concentrically on a plane. FIG. 6 is a development drawing showing a head developed in rectangular fashion on a plane. FIG. 7 is a drawing showing the left side of a head model, divided into sections using a different division scheme. FIG. 8 is a drawing showing the back of a head model, divided into sections using a different division scheme. FIG. 9 is a drawing showing the front of a head model, divided into sections using a different division scheme. FIG. 10 is a radial development drawing of the sections shown in FIGS. 7 through 9. FIG. 11 is a rectangular development drawing of the sections shown in FIGS. 7 through 9.

An explanation follows on the workings of the hairstyle design system in an embodiment of the present invention, as described in the foregoing.

First, the method for determining a hairstyle design is described. The hairstyle design system utilizes a computer-based image-processing/design system (CAD or CAM system), as used widely in industry, for the purpose of designing a hairstyle. The beautician designs the hairstyle as desired by a customer while looking at the display device 4. The customer may also design the hairstyle of her choice in the manner of playing a computer game.

Large numbers of total-head and partial-head hairstyle models are stored in the hairstyle-design information-storage device 6. A hairstyle model is the prototype information for a given hairstyle, comprising a set of data on head shape, hair color, hair length, and the type of permanent wave used for each part of the head.

To design a hairstyle as desired by a customer, the beautician operates the input/output device 2 to display a plurality of total-head hairstyle models at a time on the display device 4. Specifically, in the image-processing device 1, images of hairstyle models retrieved from the hairstyle-design information-storage device 6 are synthesized, whereupon the graphic system 3 converts the images into image data, which in turn is displayed on the display device 4. The beautician uses a mouse to select a desired hairstyle model to serve as the basic hairstyle model. The hairstyle model may be rotated freely on the display device 4.

It is possible to point to any part of the basic hairstyle model using a mouse in order to modify the part. Specifically, the beautician may retrieve and display partial-head hairstyle models from the hairstyle-design information-storage device 6, select a desired partial-head hairstyle model, and paste it onto the basic hairstyle model. The beautician may also select a color and hair length with which to modify a designated part of the basic hairstyle model. It is also possible to display a head-development drawing and directly replace, as desired, any existing numerals and/or symbols previously assigned therein. The beautician repeatedly alters a hairstyle model until the head image on the display device 4 becomes the desired hairstyle. All of the image-processing functions, as referred to in the foregoing, can be accomplished using conventional CAD/CAM systems. When a hairstyle is finally determined, the information on the modified version of the basic hairstyle model is stored as development-drawing information in the head-development drawing information-storage device 5. The design information on the hairstyle, as designed by the customer, is also stored in the hairstyle-design information-storage device 6.

The numerals and/or symbols, assigned to the sections shown in the foregoing head-development drawing, represent the hair length, type of permanent wave and color for the final hairstyle design. In the haircutting process, the numerals and/or symbols, as output from a displayed hairstyle model, represent the length of hair from the root. A numeral may represent the length in millimeters or centimeters, or a symbol may mark the hair as being long or short. In the hair-coloring process, the assigned numerals and/or symbols are used to express the color. In a permanent-wave or other hair-shaping process, numerals and/or symbols are used to represent a type of wave or ironing. Information relative to haircutting, coloring, type of permanent wave and other processes is converted into numerals and/or symbols for each part of the head-development drawing, being the major sections or subsections, and is then stored as magnetic information, thus facilitating the achievement of an ideal hairstyling process as desired by the customer and the precise reproduction of a desired hairstyle.

Secondly, the method of dividing the head into sections is described. A head-development drawing shows the surface of the head divided into a plurality of major sections and numerous subsections. The plurality of major sections, as shown in a head-development drawing, are defined by dividing the head into two along the centerline of the head, these sections being further divided into the top front, back, top side, underside and nape sections. The plurality of major sections in the head-development drawing represent the front, top, side and back sections of the head, respectively. The numerous sections in the head-development drawing are subsections as defined by subdividing the major sections into an appropriate number of smaller sections. The number of subsections in a head-development drawing may range approximately between 10 and 160. Each head-development drawing is modified to suit an individual customer.

The major sections in the head-development drawing may be in whatever number is most appropriate for a particular customer. Examples of such an appropriate number are a total of 10 sections consisting of the front top, back, top side, underside and nape sections on both the left- and right-hand sides of the centerline of the head; or a total of four sections consisting of the front, top, side and back sections. The subsections, as defined by subdividing the major sections, may be in any suitable number. An appropriate number may range approximately between 10 and 160, but preferably between 60 and 80. Given the unique characteristics of each customer's head and face, the number of subsections may be set in advance for a particular customer and the resultant head-development drawing may be stored in memory for a better-fitting hairstyle design on the customer's behalf.

Thirdly, the hair-processing method is described. When the beautician processes a customer's hair, the head-development drawing data—which includes the numerals and/or symbols representing a hairstyle—is retrieved from the head-development drawing information-storage device 5, whereupon the graphic system 3 converts the data into image data for a development drawing, which in turn is output to a monitor on the display device 4. The data is output as a development drawing in which specific items for the determined hairstyle design are entered for the divided sections of the head. Specifically, the displayed head-development drawing shows the numerals and/or symbols entered therein to represent information such as hair length, the length to be cut, type of permanent wave and type of coloring for the determined hairstyle design. The beautician cuts, colors and applies permanent waving to the hair in accordance with the numerals and/or symbols entered in the head-development drawing. The beautician may display a total-head image or partial-head image of the hairstyle on the display device 4 in order to check on the progress of hair processing. In other words, when processing hair the beautician retrieves the design information for the hairstyle of the customer's design from the hairstyle-design information-storage device 6, and reproduces it as a head image on the display device 4 for reference in processing the hair.

Obviously it is possible to process hair by referring to the head images only. However, in practice it is difficult for the beautician to process hair in perfect conformance to the customer-designed hairstyle by referring solely to the hairstyle in the head image shown on the display device 4. It is more suitable to process hair primarily according to a development drawing while using the head image as a supplement. The customer's desired hairstyle is stored in a recording medium so that it can be reproduced on the display device 4 at any time. The beautician may also use a customer's hairstyle as a basic design and modify it to suit the customer's wishes. It also follows that a customer may refer to the head image of her existing design and modify it through consultation with the beautician.

The head-development drawings to be output on the display device 4 are shown in FIGS. 5, 6, 10 and 11. To illustrate an example, the head-development drawing in FIG. 6 shows a development drawing containing a total of eight sections as defined by dividing four sections—the top front (TF), top side (TS), underside (US) and nape (NA) sections as shown in FIGS. 2 through 5—along the centerline of the head, onto which numerals and/or symbols representing the determined hairstyle design are entered. The eight sections (4×2) are subdivided into unit sections, one unit being considered a section. The sections are sequentially numbered 1 through n to identify their respective locations.

An example of a division scheme is to set up 38 sections per side—eight top front (TF), eight top side (TS), 16 underside (US) and six nape (NA) sections—or a total of 76 sections (38×2) on both the left- and right-hand sides of the centerline of the head. In this division scheme, "LTS5," for example, denotes the fifth section from the top in the left top-side area, on the left-hand side of the back centerline, in the left top side section (LTS) on the left-hand side (from the back) of the head shown in FIG. 9.

Yet another division scheme, which uses no centerline through the head but divides the entire head starting at the front of the head, may be more appropriate for certain hairstyles. In this scheme, as shown in FIGS. 7 through 9, the major sections would consist of seven sections, namely the front, top, back center, side left, back left, side right and back right, which may in turn be subdivided to define smaller sections.

For example, the head-development drawings shown in FIGS. 10 and 11 include four sections for the front (F), four for the top (T), 16 for the back center (BC), eight each for the side left (SL) and side right (SR), and 12 each for the back left (BL) and back right (BR). In this scheme, when referring to FIGS. 10 and 11, "BL3" denotes the third section from the top in the back left (BL) section. The number of sections is determined according to the customer's head and facial shape.

The use of image processing in the creation of a desired hairstyle image thus allows the design of a desired hairstyle in minute detail. A hairstyle may also be presented in a two-dimensional development drawing, with numerals and/or symbols entered therein, to enable the beautician to cut, color and apply permanent wave to the hair as desired by the customer.

Since hairstyles are designed based on the head-development drawing, hairstyles and hairstyling prescriptions can be standardized and then easily integrated and interchanged with one another. Customer preferences may be exchanged between different beauty salons over the Internet or other means, enabling the reproduction of the same hairstyle design by different beauticians or even at different beauty salons through the use of head-development drawings or hairstyle images.

As shown in the foregoing, the hairstyle design system in the embodiment of the present invention is configured in such a way that a computer-based graphic-processing system is used to facilitate the design of a hairstyle while looking at a display device, and when the beautician processes hair, a head-development drawing is output wherein numerals and/or symbols are entered for each of a plurality of divided sections. This configuration enables the design of a hairstyle as desired by the customer and the processing of hair according to the hairstyle thus created.

INDUSTRIAL FIELD OF APPLICATION

As may be evident from the foregoing explanations, the hairstyle design system of the present invention is configured to comprise: an input/output device with which to input instructions for selecting or processing images and for outputting status information; a graphic system that converts image information into image data for display; a display device for the display of head image data, as converted by the graphic system, and a head-development drawing; a head-development drawing information-storage device that stores hairstyle design data entered as numerals and/or symbols representing hair length and color and the type of permanent wave to be used for each part of the head; a hairstyle-design information-storage device that stores a plurality of hairstyle-model data sets which serve as samples for hairstyle design; and an image-processing device that outputs to the graphic system a synthesized or modified image based on the hairstyle design data, as retrieved from the head-development drawing information-storage device and the hairstyle-design information-storage device on instructions from the input/output device, and which writes the resultant processed hairstyle design data into the head-development drawing information-storage device and the hairstyle-design information-storage device; thereby providing the effect of enabling the design of a hairstyle precisely as desired by the customer, the processing of hair to accurately reproduce a predetermined hairstyle, and the standardization and exchange of hairstyle design information.

What is claimed is:

1. A hairstyle design system comprising:

an input/output device for inputting instructions for selecting or processing images and for outputting status information;

a graphic system that converts image information into image data for display;

a display device for the display of the image data;

a head-development drawing information-storage device that stores data on two-dimensional head-development drawings representing multiple hairstyle designs, said drawings showing multiply-divided sections of a hair growing region of the head, each section including numerals and/or symbols representing hair length and color and the type of permanent wave;

a hairstyle-design information-storage device that stores data on three-dimensional hairstyle designs corresponding to the two-dimensional head-development drawings, said hairstyle designs being changeable by the section; and an image-processing device that i) retrieves the data on two-dimensional head-development drawings and the data on three-dimensional hairstyle designs, ii) synthesizes image information on the two-dimensional head-development drawings and image information on the three-dimensional hairstyle designs, iii) outputs to the graphic system the synthesized image information on the two-dimensional head-development drawings and on the three-dimensional hairstyle designs to display on the display device as the image date the two-dimensional head-development drawings and on the three-dimensional hairstyle designs, iv) modifies the image information based on instructions from the input/output device, and v) saves data on two-dimensional head-development drawings and data on three-dimensional hairstyle designs into the head-development drawing information-storage device and the hairstyle-design information-storage device, respectively, as instructed via the input/output device.

2. The hairstyle design system as described in claim 1, wherein the head-development drawing consists of a plurality of major sections and numerous subsections as defined by subdividing said major sections into smaller sections.

3. The hairstyle design system as described in claim 2, wherein the plurality of major sections are divided along the centerline of the head and further divided into the front top, back, top side, underside and nape sections.

4. The hairstyle design system as described in claim 2, wherein the plurality of major sections in the head-development drawing are the front, top, side and back sections of the head.

5. The hairstyle design system as described in claim 2, wherein the numerous subsections in the head-development drawing are subsections defined by subdividing the major sections, formed by dividing the head, into smaller sections.

6. The hairstyle design system as described in claim 2, wherein the number of the sections ranges approximately between 10 and 160.

7. The hairstyle design system as described in claim 1, wherein the head-development drawing is modified to match the unique characteristics of a customer's head.

8. The hairstyle design system as described in claim 1, wherein the numerals and/or symbols entered for each of the sections of the head-development drawing represent the hair length and color and the type of permanent wave.

9. The hairstyle design system as described in claim 1, wherein the image-processing device is a CAD/CAM system.

10. The hairstyle design system according to claim 1, wherein the sections are defined by dividing the hair growing region by multiple parallel lines generally horizontal with respect to an upright human head.

11. A hairstyle design method using the hairstyle design system of claim 1, comprising:

inputting instructions to the input/output device;

retrieving the data on two-dimensional head-development drawings and the data on three-dimensional hairstyle designs stored in the head-development drawing information-storage device and the hairstyle-design information-storage device;

synthesizing image information on the two-dimensional head-development drawings and image information on the three-dimensional hairstyle designs;

outputting to the graphic system the synthesized image information on the two-dimensional head-development drawings and on the three-dimensional hairstyle designs;

converting by the graphic system the image information into image data for display;

displaying on the display device as the image date the two-dimensional head-development drawings and on the three-dimensional hairstyle designs;

selecting a hairstyle design shown on the display device by a customer or a third party;

modifying the image information based on instructions from the input/output device; and saving the modified image information into the head-development drawing information-storage device and the hairstyle-design information-storage device as instructed via the input/output device.

12. The hair-processing method according to claim 11, further comprising processing hair with reference to the two-dimensional head-development drawings displayed on the display device.

13. The hair-processing method according to claim 11, wherein in the selecting step, a beautician numerals and/or symbols corresponding to the hairstyle design in sections of the two-dimensional head-development drawing.

* * * * *